US006038945A

United States Patent [19]

Speare

[11] Patent Number: 6,038,945

[45] Date of Patent: Mar. 21, 2000

[54] NAIL STARTER INTEGRALLY FORMED IN HEAD FOR A HAMMER

[75] Inventor: William J. Speare, Williams Bay, Wis.

[73] Assignee: Speare Tools, Inc., Williams Bay, Wis.

[21] Appl. No.: 09/232,574

[22] Filed: Jan. 16, 1999

[51] Int. Cl.[7] ..... B25D 1/00

[52] U.S. Cl. ..... 81/23; 81/20

[58] Field of Search ..... 81/20, 23

[56] References Cited

U.S. PATENT DOCUMENTS

| | | | |
|---|---|---|---|
| D. 299,213 | 1/1989 | Puntillo . | |
| D. 319,567 | 9/1991 | Furey . | |
| 543,255 | 7/1895 | Lewis | 81/23 |
| 640,169 | 1/1900 | Bargar | 81/23 |
| 735,877 | 8/1903 | Horton . | |
| 1,752,588 | 4/1930 | Clark | 81/23 |
| 2,574,304 | 11/1951 | Vigil . | |
| 3,788,373 | 1/1974 | Aherin . | |
| 4,193,433 | 3/1980 | Sickler . | |
| 4,270,587 | 6/1981 | Ludy . | |
| 4,273,172 | 6/1981 | Hoosier . | |
| 4,798,107 | 1/1989 | Furey . | |
| 4,843,925 | 7/1989 | Furey . | |
| 5,852,959 | 12/1998 | Speare | 81/23 |

FOREIGN PATENT DOCUMENTS

| | | |
|---|---|---|
| 203924 | 9/1920 | Canada . |

*Primary Examiner*—James G. Smith
*Assistant Examiner*—David B Thomas
*Attorney, Agent, or Firm*—Michael Best & Friedrich LLP

[57] ABSTRACT

A nail starter for a hammer includes integral protrusions and a spring member disposed between these two protrusions for releasably holding the body of a nail in a predetermined position.

6 Claims, 1 Drawing Sheet

NAIL STARTER INTEGRALLY FORMED IN HEAD FOR A HAMMER

BACKGROUND OF THE INVENTION

1. Field of the Invention

The present invention generally relates to a nail starter for a hammer that secures a nail to a side of the hammer's head and allows a user to start driving the nail into a receiving body.

2. Description of the Prior Art

The prior art includes a variety of hammer attachments designed to releasably secure a nail to a hammer and facilitate the "starting" of the nail, i.e., the initial penetration of the nail to a receiving body. U.S. Pat. No. 4,270,587 titled "Nail Holder For Hammer" and issued on Jun. 2, 1981 to Ludy, describes such an attachment. The Ludy attachment includes a pair of spring arms that extend around the handle of the hammer and a pair of cantilever members. The cantilever members lie proximate the head of the hammer in overlapping relation. They hold the head of a nail between their end portions.

Other prior art references that disclose attachments similar to the Ludy attachment include: U.S. Design Pat. No. Des. 299,213 to Puntillo; U.S. Design Pat. No. Des. 319, 567; U.S. Pat. No. 4,798,107 to Furey; U.S. Pat. No. 4,658,679 to Nitzberg et al.; and U.S. Pat. No. 3,788,373 to Aherin. Still other prior art references such as U.S. Pat. No. 4,273,172 to Hoosier and U.S. Pat. No. 4,193,433 to Sickler disclose hammers with heads that include integrally formed structure that releasably secures a nail so that the nail extends outwardly of the front or rear of the head.

The devices and structure disclosed in those references do not provide a suitable means of securely holding a nail on the head of a hammer. In contrast, the nail starter of the present invention releasably secures a nail with the head of the nail disposed against the head of the hammer and the body of the nail supported in such a manner that a user may easily drive it into a receiving body. It is a simple construction that minimizes the cost of manufacture and allows the quick and easy starting of nails.

SUMMARY OF THE INVENTION

In accordance with the embodiment of the present invention, a nail starter includes a spring supported by a pair of protrusions that are integrally formed in the head of the hammer. The spring supports the nail by engaging the body of the nail and holding it in a predetermined position.

BRIEF DESCRIPTION OF THE DRAWINGS

For a more complete understanding of this invention, one should now refer to the embodiments illustrated in greater detail in the accompanying drawings and described below by way of an example of the invention. In the drawings.

DESCRIPTION OF THE PREFERRED EMBODIMENT

While the following disclosure describes the invention in connection with a number of embodiments and modifications, one should understand that the invention is not limited to these embodiments and modifications. Furthermore, one should understand that the drawings are not to scale and that graphic symbols, diagrammatic representatives, and fragmentary views, in part, may illustrate the embodiment and modifications. In certain instances, the disclosure may not include details which are not necessary for an understanding of the present invention such as conventional details of fabrication and assembly.

Figure 1:
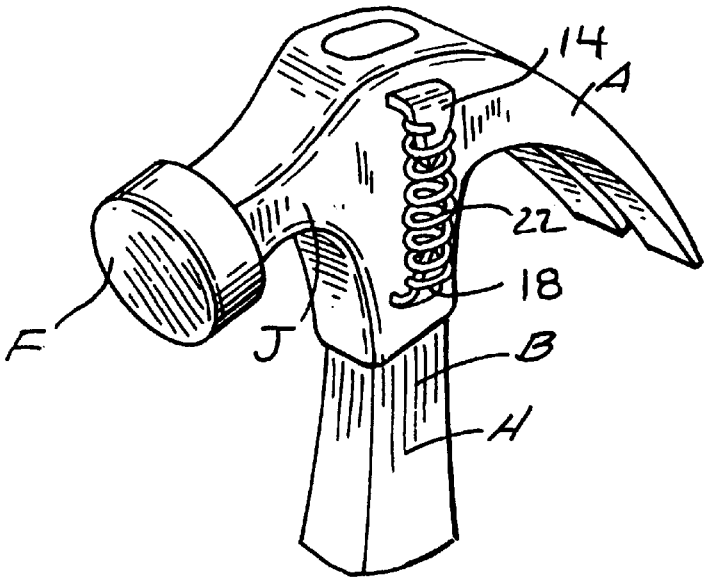
FIG. 1 is a perspective view of a hammer with a nail starting device embodying the present invention.

Turning now to the drawings, FIG. 1 shows the hammer H and integral nail starter 10 of the present invention. The hammer H includes a head A fixed to one end of an elongated handle B. The head A includes a striking face F and two opposing side faces J (only one side face is shown). The nail starter 10 is located on at least one of the side faces J and includes integral protrusions 14 and 18 and a spring member 22 disposed between these two protrusions 14 and 18. Preferably, the spring member 22 is releasably secured to the protrusions and is a helical compression spring made out of a resilient metal or any other suitable material.

Figure 2:
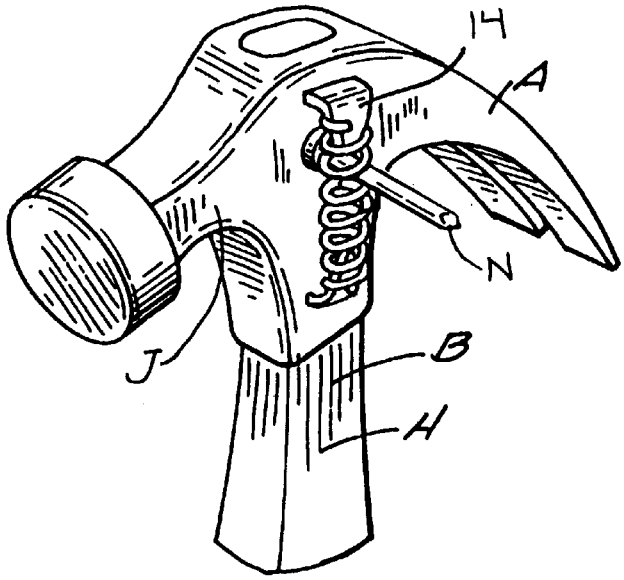
FIG. 2 is a perspective view of the hammer and nail starting device shown in FIG. 1 and holding a nail on the head of the hammer.

As shown in FIG. 2, the pocket between the side face J and the spring member 22 receives the head of a nail N and adjacent winds of the spring member 22 releasably secure the nail N to the hammer head A and allow a user to drive the nail N into a receiving body S. The stabilizing forces provided by the spring member 22 facilitate the driving of the nail N into a receiving body (not shown) and prevent the nail N from popping out of the position shown in FIG. 2.

In operation, a nail N is placed into position on the hammer head as shown in FIG. 2. The nail is then started into a receiving body at which point the nail N can be withdrawn from the nail starter 10 and driven further into the receiving body using the striking face F.

While the above description and the drawings disclose and illustrate a number of embodiments and modifications, one should understand, of course, that the invention is not limited to these embodiments and modifications. Those skilled in the art to which the invention pertains may make other modifications and other embodiments employing the principles of this invention, particularly upon considering the foregoing teachings. For example, the embodiment shown in FIG. 1 may have the protrusions disposed in a recess formed into the head of the hammer. Therefore, by the appended claims, the applicant intends to cover any modifications and other embodiments as incorporate those features which constitute the essential features of this invention.

What is claimed is:

1. A hammer comprising:

an elongated handle having an end;

a head member fixed to the end of the handle, the head member having a pair of opposed side faces and a striking face; and securing means for holding a nail against one of the pair of side faces, the securing means including a pair of spaced apart protrusions integrally formed with the head member and extending from the one side face and a spring extending between the protrusions and being secured to the protrusions.

2. The hammer of claim 1, wherein the spring is a helical compression spring.

3. The hammer of claim 1, wherein the spring is releasably secured to the protrusions.

4. A hammer comprising:

an elongated handle having an end;

a head member fixed to the end of the handle, the head member having a pair of opposed side faces and a striking face; and a securing member for holding a nail against one of the pair of side faces, the securing member including a pair of spaced apart protrusions integrally formed with the head member and extending from the one side face and a spring extending between the protrusions and being secured to the protrusions.

5. The hammer of claim 4, wherein the spring is a helical compression spring.

6. The hammer of claim 4, wherein the spring is releasably secured to the protrusions.

* * * * *